US010596418B2

(12) United States Patent
Pallesen et al.

(10) Patent No.: US 10,596,418 B2
(45) Date of Patent: Mar. 24, 2020

(54) AQUATIC EXERCISE DEVICE

(71) Applicant: Aqua Group Limited, Auckland (NZ)

(72) Inventors: John Douglas Pallesen, Auckland (NZ); Robert Delaney Tucker Mitchell, La Jolla, CA (US); Steven J. Kennedy, San Diego, CA (US)

(73) Assignee: Aqua Group Limited, Auckland (NZ)

( * ) Notice: Subject to any disclaimer, the term of this patent is extended or adjusted under 35 U.S.C. 154(b) by 0 days.

(21) Appl. No.: 16/382,886

(22) Filed: Apr. 12, 2019

(65) Prior Publication Data

US 2019/0314684 A1 Oct. 17, 2019

(30) Foreign Application Priority Data

Apr. 13, 2018 (NZ) ..... 741628

(51) Int. Cl.

| | |
|---|---|
| ***A63B 31/10*** | (2006.01) |
| *A63B 21/00* | (2006.01) |
| *A63B 21/065* | (2006.01) |
| *A63B 21/008* | (2006.01) |

(52) U.S. Cl.

CPC ..... *A63B 31/10* (2013.01); *A63B 21/0084* (2013.01); *A63B 21/065* (2013.01); *A63B 21/4001* (2015.10)

(58) Field of Classification Search

CPC . A63B 31/10; A63B 21/4001; A63B 21/0084; A63B 21/065

See application file for complete search history.

(56) References Cited

U.S. PATENT DOCUMENTS

| | | | | | |
|---|---|---|---|---|---|
| 3,109,186 | A * | 11/1963 | Glenn | A63B 31/12 | 441/60 |
| 3,424,133 | A * | 1/1969 | Brady | A01K 15/027 | 119/702 |
| 4,565,369 | A * | 1/1986 | Bedgood | A63B 21/0084 | 482/111 |
| 4,632,387 | A * | 12/1986 | Guzman | A63B 21/0084 | 441/58 |
| 4,756,699 | A * | 7/1988 | Brom | A63B 31/14 | 441/59 |
| 6,364,727 | B1 * | 4/2002 | Rangel | A63B 31/12 | 441/59 |
| 6,436,014 | B1 * | 8/2002 | Cirjak | A63B 21/0606 | 446/26 |
| 7,621,851 | B2 * | 11/2009 | Stout | A63B 21/0004 | 482/55 |

(Continued)

*Primary Examiner* — S. Joseph Morano
*Assistant Examiner* — Jovon E Hayes
(74) *Attorney, Agent, or Firm* — Dann, Dorfman, Herrell and Skillman, P.C.

(57) ABSTRACT

A fin assembly for aqua resistance exercise comprises a strap having an inner strap and an outer strap, and with fastener(s) provided to an outside of the inner strap and an inside of the outer strap to releasably attach the inner and outer straps together. One or more fins are received on the outer strap and a longitudinal position of the one or more fins is secured by engagement of the inner strap to the outer strap. The length of the inner strap is longer than a length of the outer strap, so that an extending end portion of the outer strap can overlap and engage an opposite end of the outer strap to secure the fin assembly about the user's limb.

20 Claims, 8 Drawing Sheets

(56) References Cited

U.S. PATENT DOCUMENTS

| | | | | |
|---|---|---|---|---|
| 7,794,364 | B2 * | 9/2010 | Killgore | A43B 5/08 441/61 |
| 8,246,523 | B2 * | 8/2012 | Stout | A63B 21/0004 482/55 |
| 8,652,013 | B2 * | 2/2014 | Stout | A63B 21/0004 482/55 |
| 8,790,224 | B1 * | 7/2014 | Davis | A63B 21/0084 441/50 |
| 9,566,463 | B2 * | 2/2017 | Stout | A63B 21/0004 |
| 9,833,651 | B2 * | 12/2017 | Stout | A63B 21/0004 |
| 10,149,994 | B1 * | 12/2018 | Pluim Mentz | A63B 21/0084 |
| 10,300,320 | B2 * | 5/2019 | Pallesen | A63B 21/4025 |
| 2004/0097342 | A1 * | 5/2004 | Stout | A63B 21/0004 482/55 |
| 2017/0361144 | A1 | 12/2017 | Pallesen et al. | |
| 2019/0314684 | A1 * | 10/2019 | Pallesen | A63B 31/10 |

* cited by examiner

AQUATIC EXERCISE DEVICE

STATEMENT OF CORRESPONDING APPLICATIONS

This application is based on the provisional specification filed in relation to New Zealand Patent Application Number 741628, the entire contents of which are incorporated herein by reference.

FIELD OF INVENTION

The present invention relates to aqua exercise equipment, and specifically to aqua leg fin devices providing water resistance for exercise.

BACKGROUND TO THE INVENTION

Aquatic exercise such as aqua aerobics may be performed for improving or maintaining fitness or for rehabilitation, for example from injury. Land based exercise can involve high stresses on muscles and joints due to gravity, for example when running or jumping. Exercising in water can avoid such stresses due to the buoyancy force provided by the water counteracting a person's body weight. Thus, aqua exercise may be particularly attractive to the elderly or overweight people, or to people recovering from injury or requiring physical rehabilitation, as the water supports the person during exercise.

Such benefits of exercising in water are advantageous to people of all ages and levels of fitness, including healthy and athletic people. Exercising in water may also be particularly useful to those who have a high level of fitness including elite athletes, as water provides resistance against movement that is proportional to the effort exerted in movement. Moving quickly in water increases the amount of resistance acting on a person's body many times more than resistance due to air when performing the same motion on land.

The use of aqua resistance equipment may be used to increase the resistance that water provides against a user's movement in water to improve strength and aerobic fitness and other related benefits, while avoiding land based disadvantages caused by gravity acting on the body when performing exercises.

Example leg fin devices are described in WO2016/083984 and U.S. Pat. No. 7,621,851. Aqua exercise resistance equipment may be difficult to use. For example, aqua exercise resistance equipment may not provide a correct or desired level of resistance against movement in water. Also, equipment can be difficult for a user to attach, or to adjust for use by different people, or to adjust to create different levels of resistance for one person to satisfy a personal training regime. Components of equipment can deteriorate when used in chlorinated water and an entire equipment assembly may need to be replaced. Furthermore, aqua exercise resistance equipment may provide an unbalanced or different level of resistance in opposite directions of movement which can be undesirable.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

OBJECT OF THE INVENTION

It is an object of the present invention to provide an improved aqua exercise device that addresses one or more of the above-mentioned disadvantages, or to at least provide the industry or the public a useful choice.

SUMMARY OF THE INVENTION

According to a first aspect of the invention, there is provided a fin assembly for aqua resistance exercise, comprising:

a strap comprising an inner strap and an outer strap, fastener(s) provided to an outside of the inner strap and an inside of the outer strap to releasably attach the inner and outer straps together, and one or more fins adapted to be received on the outer strap, a longitudinal position of the one or more fins secured by engagement of the inner strap to the outer strap, and wherein the length of the outer strap is longer than a length of the inner strap, so that an extending end portion of the outer strap can overlap and engage an opposite end of the outer strap to secure the fin assembly about the user's limb.

In some embodiments, the fasteners releasably attach the inner and outer straps together along substantially a full length of the inner strap.

In some embodiments, the fasteners are hook and loop type fasteners.

In some embodiments, the hooks or loops of the hook and loop fasteners is applied over substantially the full surface of the inner side of the outer strap, and the other of the hooks and loops is applied over substantially the full surface of the outer side of the inner strap.

In some embodiments, a fastener first-half is provided to the outside of the inner strap, and a corresponding opposite fastener second-half is provided to the inside of the outer strap to releasably attach to the fastener first half to releasably attach the inner and outer straps together, and a said fastener first half is provided to the outside of the outer strap, so that the inside of the extending end portion of the outer strap is releaseably attachable to the outside of an opposite end of the outer strap when the strap is wrapped around a user's limb.

In some embodiments, the fastener first half is hooks or loops of hook and loop fasteners and the fastener second half is corresponding loops or hooks of the hook and loops fasteners.

In some embodiments, the fastener first half covers substantially the full outside surface of outer strap, and/or the fastener first half covers substantially the full outside surface of inner strap, and/or the fastener second half substantially the full inside surface of outer strap.

In some embodiments, each fin comprises a base and a longitudinal fin extending from the base, and wherein the base comprises a first aperture and a second aperture spaced apart in a longitudinal direction of the strap, so that the outer strap passes through the first aperture and the second aperture to receive the fin on the outer strap.

In some embodiments, the base comprises a first lateral side member, a central lateral member and a second lateral side member, the first aperture positioned between the first lateral side member and the central lateral side member, and the second aperture positioned between the central lateral member and the second lateral side member, and wherein a relative position of the central member to the first and second side members causes the outer strap to bend across the central member so that the inner surface of the outer strap is proud of an inner surface of each of the two side members to secure the outer strap to the inner strap by said fasteners between the first and second side members.

In some embodiments, the fin has a first lateral fin and a second lateral fin, wherein the first and second lateral fins are adjacent to an upper edge and a lower edge of the outer strap.

In some embodiments, the fin has an opening between the longitudinal fin and the base, and the opening extends substantially the full width of the outer strap.

In some embodiments, the outer strap comprises indicators to indicate to a user a correct position to locate the one or more fins on the outer strap.

In some embodiments, each indicator comprises one or more cut-out portions of the outer strap.

In some embodiments, the fin comprises a projection to be received in a corresponding cut-out portion.

In some embodiments, the fin comprises a projection, to be received in a corresponding cut-out portion in the outer strap to position the fin correctly along the outer strap, and wherein the projection is located on the central lateral member of the base.

In some embodiments, the outer strap and the inner strap are completely separable.

In some embodiments, the outer strap is substantially non-extendable.

In some embodiments, the outer strap is a strap or strap of hook material forming one side of the outer strap bonded to a strap or strap of loop material forming an opposite side of the outer strap (back-to-back hook and loop material).

In some embodiments, the outer strap is stamped from a sheet of material comprising a sheet of hook material forming one side of the sheet material bonded to a sheet of loop material forming an opposite side of the sheet material.

In some embodiments, the inner strap preferably comprises a cushioning material.

In some embodiments, the inner strap is without an elasticated section.

In some embodiments, the inner strap comprises a cushioning material and the fastener between the inner and outer straps is hook and loop material, and the hook or loop material of the inner strap is bonded to the cushion material of the inner strap to form the outside of the inner strap.

In some embodiments, the assembly comprises a plurality of fins.

According to a second aspect of the invention, there is provided a kit of parts for a fin assembly for aqua resistance exercise, comprising:

a strap comprising an inner strap with fasteners provided to an outside surface of the inner strap, an outer strap with fasteners provided in an inside surface of the outer strap, the fasteners adapted to releasably attach the inner and outer straps together, and one or more fins adapted to be received on the outer strap, wherein a longitudinal position of the one or more fins fixed by engagement of the inner strap to the outer strap, and wherein the length of the outer strap is longer than a length of the inner strap, so that an extending end portion of the outer strap can overlap and engage an opposite end of the outer strap to secure the fin assembly about the user's limb.

In some embodiments, the kit of parts comprises a range of different fin sizes, each to provide a different resistance level in water.

Further aspects of the invention, which should be considered in all its novel aspects, will become apparent to those skilled in the art upon reading of the following description which provides at least one example of a practical application of the invention.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of example only.

BRIEF DESCRIPTION OF THE DRAWINGS

Further aspects of the present invention will become apparent from the ensuing description which is given by way of example only and with reference to the accompanying drawings in which.

DESCRIPTION OF PREFERRED EMBODIMENTS OF THE INVENTION

Figure 1:
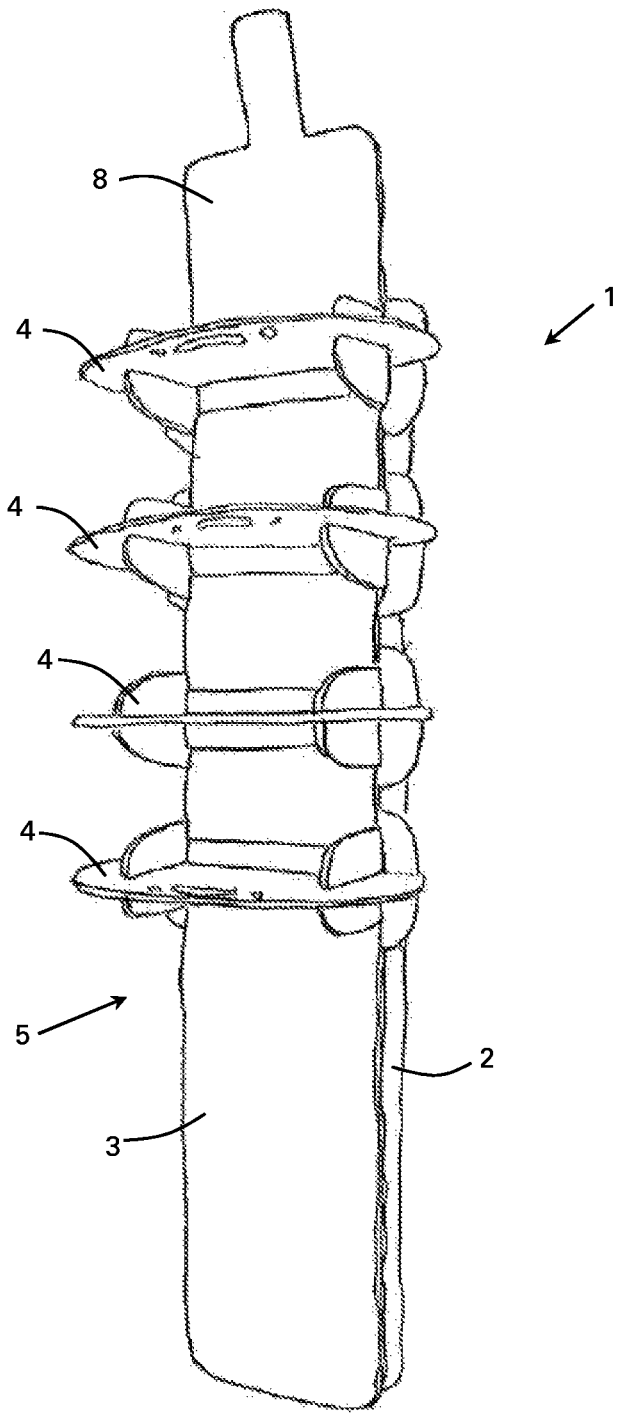
FIG. 1 shows a leg-fin assembly.

An aqua leg or arm fin strap assembly (or 'fin assembly') is described with reference to the above figures. The fin assembly 1 may be attached to a user's leg below the knee, to provide resistance against movement of the user's leg through water, for example in a swimming pool. Typically, a user will wear a leg fin assembly on each leg. Alternatively, a user may wear the fin assembly 1 on the user's forearm. The fin assembly 1 is particularly useful for strengthening or otherwise conditioning a person's legs or body, and for improving aerobic conditioning, cardiovascular endurance and increasing flexibility.

A fin assembly 1 according to the present invention comprises a strap 5. The strap 5 has an inner strap 2 and an outer strap 3. The inner strap 2 is attached to the outer strap 3 by fasteners to attach an outer surface of the inner strap to an inner surface of the outer strap. The fasteners are adapted to attach the inner and outer straps together along a length portion of the inner strap and preferably along a full length of the inner strap. In a most preferred embodiment the fasteners are hook and loop type fasteners such as Velcro®. Preferably one half (e.g. the hook half or the loop half) of the hook and loop fasteners is applied over substantially the full surface of the inner side of the outer strap, and the other half of the hook and loop fasteners is applied over substantially the full surface of the outer side of the inner strap. Other fastener arrangements may be used, for example fasteners that have a female half or connector part and a male half or connector part, such as in a snap fastener comprising male and female interlocking parts, where a plurality of such fasteners is applied with the fasteners spaced apart along the length of the strap.

One or more fins 4 are received on the outer strap 3, preferably a plurality of fins is received on the outer strap. The most preferred embodiment has four fins, however more or less fins may be provided. Each fin 4 has an aperture 11, 12 through which the outer strap is threaded so that the fin is received on the outer strap. With the fins 4 received on the outer strap 3, the outer strap 3 and the inner strap 2 are fastened together by the fasteners to secure the longitudinal position of the fins 4 on the strap 5. The longitudinal position of each fin on the strap is fixed by engagement between the inner and outer straps.

The length of the outer strap 3 is longer than the length of the inner strap 2. The outside of the inner strap has a fastener half that is opposite to the fastener half on the inside of the outer strap. For example, the outside of the inner strap may have loops 6 of a hook and loop fastener, the inside of the outer strap having corresponding hooks 7 of the hook and loop fastener. The outside of the outer strap 3 has a corresponding fastener half opposite to the fastener half on the inside of the outer strap. For example, where the inside of the outer strap 3 has hooks 7, the outside of the outer strap has corresponding loops 6, to form a hook and loop fastener with the hooks of the inside of the outer strap. As the outer strap is longer than the inner strap, with the outer strap 3 secured to the inner strap 2, one end of the outer strap is aligned with one end of the inner strap, and an opposite end of the outer strap extends beyond the corresponding end of the inner strap. With the strap wrapped around a user's limb, the extending portion 8 of the outer strap can wrap over the opposite end of the strap 5 so that the inside of the extending portion 8 of the outer strap 3 engages the outside of the opposite end of the outer strap 3. In a preferred embodiment, the fastener half covers substantially the full surface of the outside of the outer strap.

Figure 5:
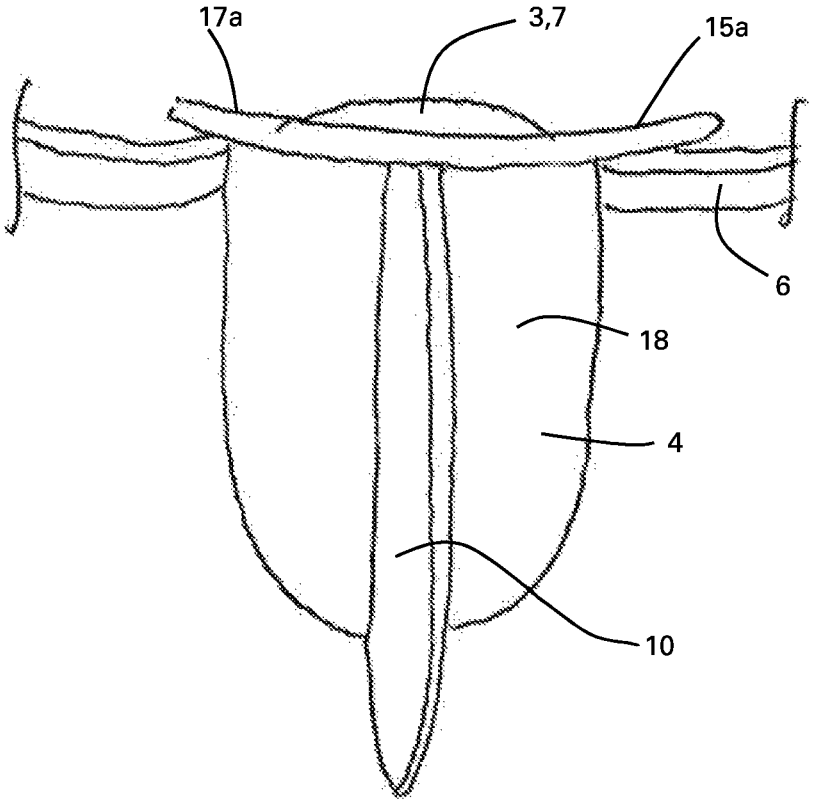
FIG. 5 is a top view of a fin of the leg-fin assembly received on an outer strap of the leg-fin assembly.

In the preferred embodiment, the fin 4 has two apertures 11, 12 spaced apart (refer FIG. 7C), so that the outer strap 3 passes through a first aperture 11 and a second aperture 12 to receive the fin 4 on the outer strap 3. The fin has a base 13 with the two spaced apart apertures, with the base configured similar to a tri-glide buckle, so that the outer strap 3 extends over a first lateral side member 15, through the first aperture, under a second (central) lateral member 16, through the second aperture, and over a third lateral member (a second side member) 17. The two side members 15, 17 and the central member 16 are arranged so that with the fin 4 received on the outer strap 3, the outer strap bends through the two apertures 11, 12 and across the central member 16 so that the inner surface of the outer strap 3 is proud of an inner surface 15*a*, 17*a* of each of the two side members 15, 17, as shown in FIG. 5. This arrangement of the side members 15, 17 and the central member 16 is important so that a portion of the outer strap 3 located between the side members 15, 17 can contact the outer surface of the inner strap to engage the fasteners between the inner and outer straps. Adjacent fins 4 may be arranged close together long the strap, or even with the bases 13 of adjacent fins in contact, or a fin 4 may be located at an end of the inner or outer strap. Engagement between the inner and outer straps is therefore not possible between adjacent fins that are spaced close together, or on one side of a fin located at or near to an end of the inner or outer strap. Engagement of the outer strap 3 with a portion of the inner strap 2 located between the side members 15, 17 of each fin 4 is predominantly achieved by the arrangement of the side members and central member described above, to ensure secure positioning of the fins along the strap so that the fins do not shift on the strap during use.

Figure 7A:
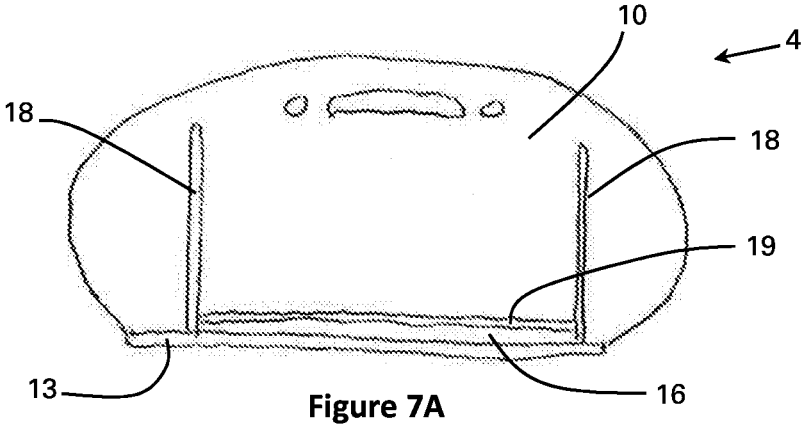
FIG. 7A is a side view of a medium sized fin.
Figure 7B:
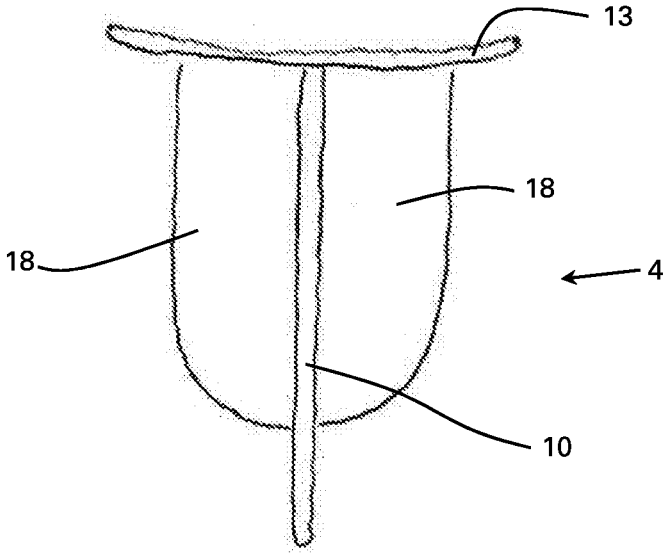
FIG. 7B is a top view of a medium sized fin.
Figure 7C:
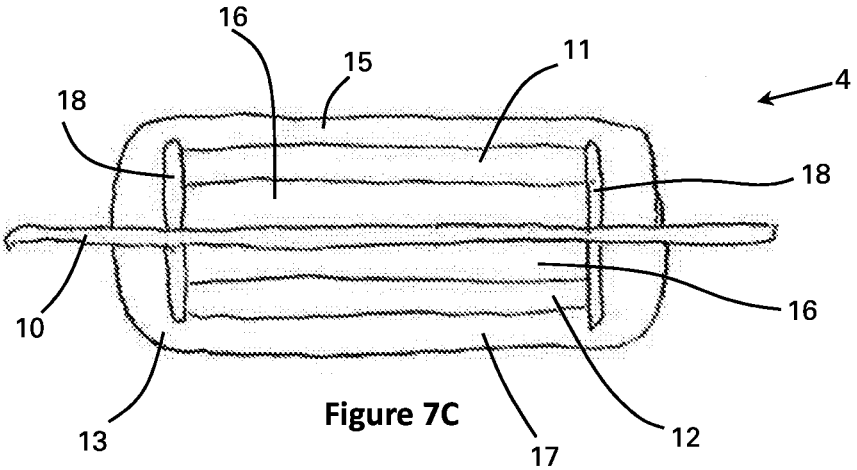
FIG. 7C is an end view of a medium sized fin.
Figure 9:
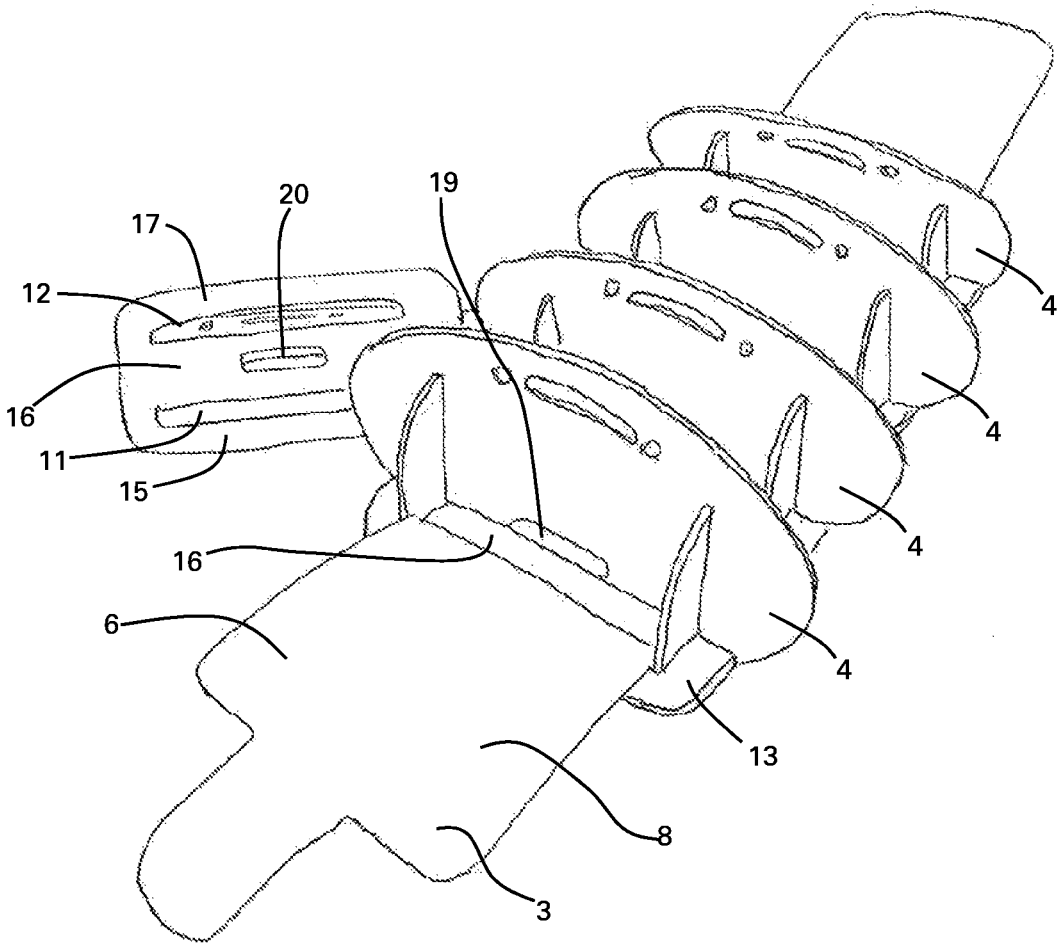
FIG. 9 shows the fins and outer strap from FIG. 8 viewed from an outer side of the outer strap, and another fin design the assembled outer strap and fins.

The fin 4 has a plate member 10 extending from the base 13. When the fin assembly is attached to a user's limb the plate 10 of each fin 4 extends approximately radially outwards from the user's limb. In use, when attached to a user's limb the plate members 10 are arranged approximately parallel to the user's limb and therefore may be described as longitudinal fins. The fin 4 preferably has one or more lateral fins 18, e.g. fins that extend parallel to the strap 3. The preferred fin 4 has two spaced apart lateral fins 18 on each side of the longitudinal fin 10. The lateral fins border the apertures 11, 12 and strap 3, so that the lateral fins 18 are closely aligned with or adjacent to edges of the outer strap, i.e. in use an upper edge and a lower edge of the outer strap 3. The lateral fins 18 are parallel to the strap edges. In a region between the lateral fins, the fin 4 has an opening 19 (FIG. 7A) between the longitudinal fin 10 and the base 13 or central member 16 of the base. In FIG. 7A the opening 19 extends substantially the full width of the outer strap 3. Opening 19 may extend for a portion of the width of the outer strap, as shown in FIG. 9. Preferably the opening is centred between the lateral fins to be located on a centreline of the fin 4. The opening 19 allows for water flow from one side of the longitudinal fin 10 to the other along the outer surface of the outer strap 3, which may assist in achieving a more balanced resistance to movement of the fin through water since water can flow around both longitudinal edges of the longitudinal fin. The opening 19 may also allow the central lateral member 16 of the base to flex since it is not reinforced by the longitudinal fin 10 over the width of the outer strap 3. This flexibility may assist with comfort for the user as the strap 3, 4, 5 is less rigidised in a width direction of the strap compared to a leg fin assembly with a fin 4 without such an opening 19. Additionally, the opening 19 provides some flexibility to the longitudinal fin 10, to flex in a length direction of the strap 5 which may impart an improved feel of the movement of the fin assembly in water.

Preferably the fin 4 is a unitary component formed from a relatively rigid material, such as a relatively rigid plastic material. A suitable material is ABS.

Figure 4:
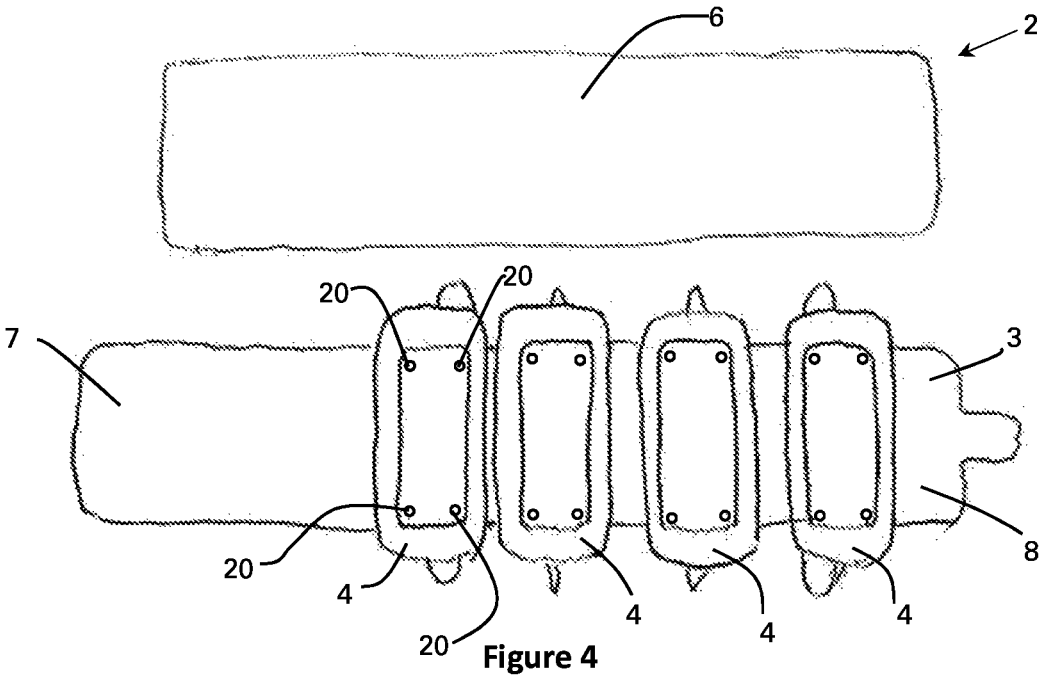
FIG. 4 shows the leg-fin assembly of FIG. 1 but with an inner strap separated from an outer strap of the assembly.
Figure 8:
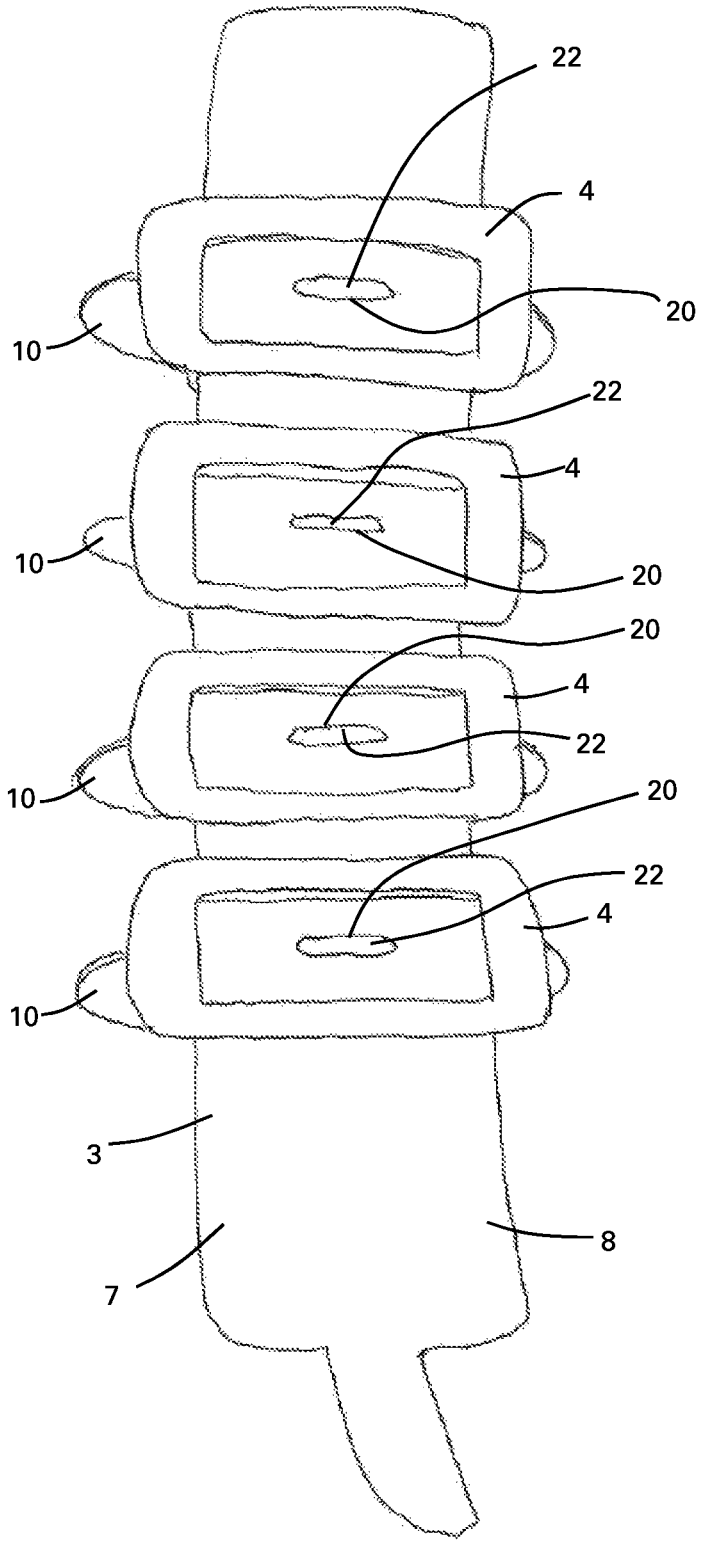
FIG. 8 shows four fins assembled to an outer strap of another leg fin assembly viewed on an inside of the outer strap.

The outer strap 3 may include indicators to indicate to a user a correct position to locate the fins on the strap. By correctly positioning the fins on the strap, the leg fin can be configured to achieve desired properties in the water. For example, equi-spacing the fins can achieve an omni-directional fluid resistance during motion in water when the fin assembly encircles a user's limb. The indicators may be markings but are preferably notches or apertures 20 cut in or through the strap. For example, an indicator may comprise a pair of notches, each notch cut in an edge of the outer strap, and/or may comprise one or more holes 20 (e.g. 2-5 mm diameter) cut through the outer strap, as shown in FIG. 4. As shown in FIG. 8, in some embodiments, the indicator is a hole 20 cut in the outer strap. The indicators such as notches or holes may be aligned with a marking or one or more protrusions on the fin base that fit into the indicator notch or hole. A protrusion 22 can be seen on a fin 4 in FIG. 9. In the embodiment of FIGS. 8 and 9, the protrusion 22 is located on the central member 16 of the base of the fin. As explained above, the two side members 15, 17 and the central member 16 of the fin base are arranged so that with the fin 4 received on the outer strap 3, the outer strap bends through the two apertures 11, 12 and across the central member 16 so that the inner surface of the outer strap 3 is proud of an inner surface 15*a*, 17*a* of each of the two side members 15, 17. The projection 22 is located on the central member and positively engages the hole 20 as the inner strap bends through the apertures 11, 12 and over the central member 16, to positively locate the fin on the outer strap.

Figure 2A:
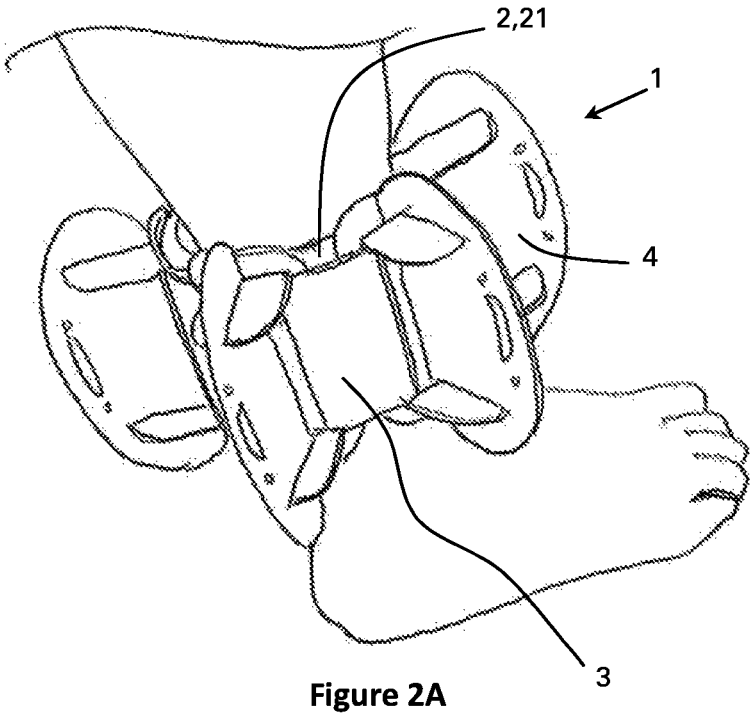
FIG. 2A shows the leg-fin assembly of FIG. 1 attached to a user's leg.
Figure 2B:
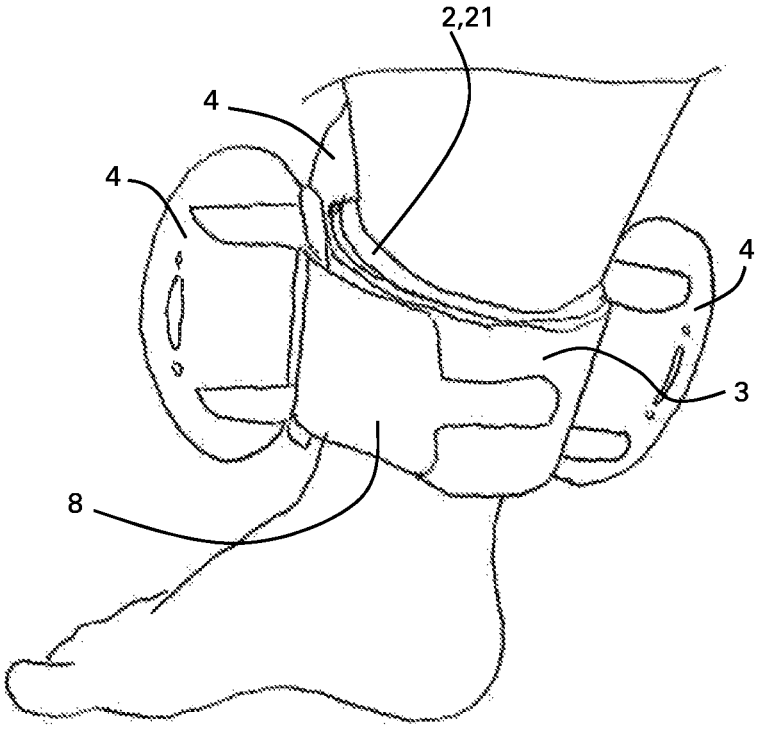
FIG. 2B Shows the leg-fin assembly of FIG. 1 attached to a user's leg from another angle.
Figure 3:
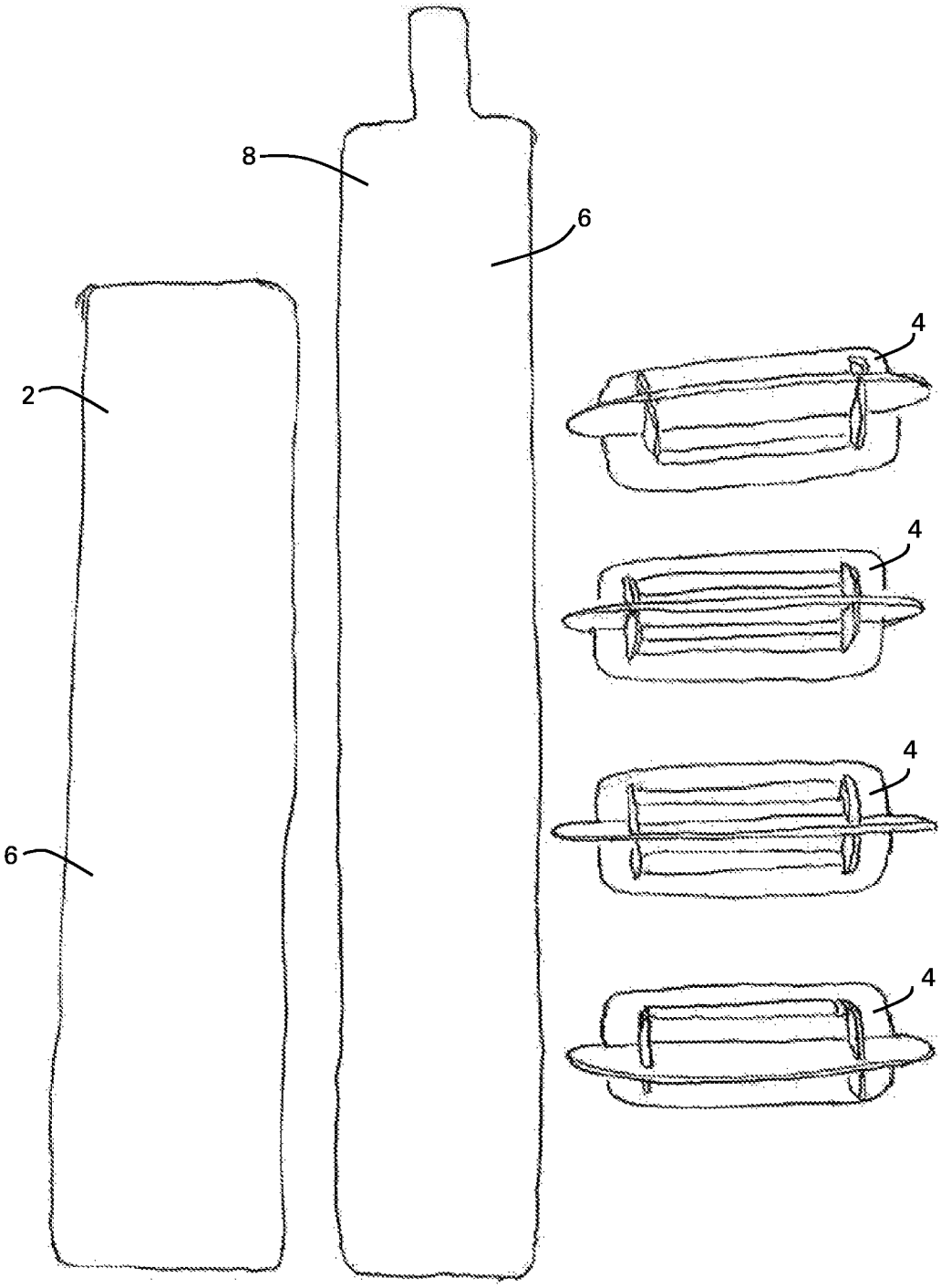
FIG. 3 shows a kit of parts for the leg-fin assembly of FIG. 1.

Preferably the outer strap 3 and the inner strap 2 are separable, so that the outer strap 3 can be completely removed from the inner strap 2, as shown in FIGS. 3 and 4. A user may thread a plurality of fins 4 onto the outer strap 3, and then attach the outer strap 3 to the inner strap 2, with one end of the outer strap overhanging the inner strap to present the extending portion 8 at one end of the strap 5. The fin assembly 1 can then be wrapped around a user's leg, with the overhanging end 8 of the outer strap 3 lapping over the opposite end of the outer strap 3 to secure the assembly to the user's limb, as shown in FIG. 2B. Preferably the outer strap is substantially non-extendable, it is without a portion that provides stretch, i.e. the outer strap is without an elasticated section. The outer strap cannot noticeably stretch in length direction under normal operating conditions.

In a most preferred embodiment, the outer strap 3 is a strap or strap of hook material bonded to a strap or strap of loop material. Such a material may be purchased in sheet form, such that the outer strap may be manufactured by simply stamping the strap from the sheet material. Where the outer strap includes fin position indicators, these may be cut-outs such as notches or holes as described above, and may be stamped in the same stamping operation as used to cut the outer strap from the sheet material. No additional manufacturing steps such as bonding or stitching are necessary for forming the outer strap beyond the single stamping operation. This configuration significantly simplifies manufacturing. Sheet material with loop fasteners on one side and hook fasteners on a second opposite side (e.g. back-to-back hook and loop material) is readily available.

The inner strap 2 preferably comprises a cushioning material 21. For example, the cushioning material comprises Neoprene®. The thickness of the cushioning material may be in the range of about 2 mm to 10 mm, or more preferably 5 mm to 10 mm. The inner strap 3 may have some limited stretch in the length direction given it is formed of a resilient material to provide cushioning. However, the inner strap 2 is without elastication (e.g. elastic sections), so that the inner strap is not stretched about the user's limb in use. Without an elasticated section, the inner strap 2 does not form a tight or secure binding about the user's limb, and so the limb is not compressed by the inner strap 2. The inner strap 2 is held to the user's limb by the outer strap 3 wrapping around the limb and inner strap 2 and securing to itself by the overlapping extending portion 8. Where the fasteners between the inner and outer straps is hook and loop material, preferably the hook or loop material 6 of the inner strap 2 is bonded to the cushion material of the inner strap. Neoprene can be purchased in sheet material with loop material 6 bonded to the Neoprene to form one side of the sheet material. The inner strap may be manufactured by simply stamping the strap from the sheet material. No additional manufacturing steps such as bonding or stitching are necessary for forming the inner strap beyond the single stamping operation. This configuration significantly simplifies manufacturing. Neoprene® with loop fasteners attached to one side is readily available.

Figure 6:
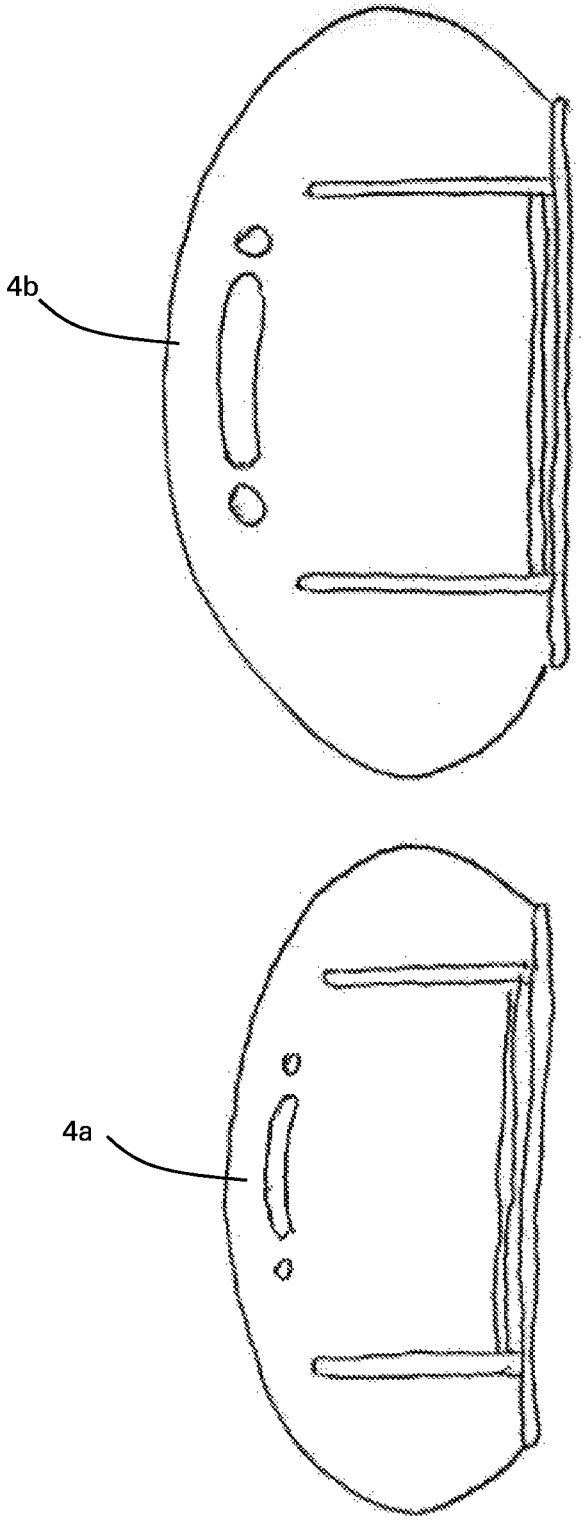
FIG. 6 shows a series of three different size fins for a leg-fin assembly.

The fin assembly 1 may be provided as an unassembled kit of parts, comprising the plurality of fins 4, the inner strap 2 and the outer strap 3. The fins may be injection moulded from plastic. Manufacturability is therefore simplified in that the inner strap and the outer strap may each be formed in a single stamping operation, as described above, and the fins formed in a single injection moulding operation. The parts are bagged or packaged with instructions for assembly. Assembly instructions may include instructions to correctly position the fin(s) on the outer strap with the fins aligned with indicators 19 on the strap, (e.g. to fit the fin projection in a corresponding hole in the outer strap). Furthermore, the strap materials of aqua fins are susceptible to discolouration and degradation through normal use and typically require replacement after 12 to 24 months of use. In a fin according to the present invention, the inner and/or outer strap may be replaced, without a requirement to replace the whole fin assembly, by simply removing the fins from the outer strap and applying to a new strap. The fins may be reused indefinitely with replacement straps. A package may be provided with a range of different fin sizes, for example, a small fin 4*a* and a large fin 4*b*, as shown in FIG. 6. A range of fins may comprise a small fin, medium fin and large fin, or more than 3 different sized fins. Alternatively, different sized fins may be purchased separately. A user wishing to alter the intensity of a workout may remove one size of fins from the strap and replace with a smaller or a larger set of fins, to achieve an easier or harder work out.

The invention may also be said broadly to consist in the parts, elements and features referred to or indicated in the specification of the application, individually or collectively, in any or all combinations of two or more of said parts, elements or features.

Aspects of the present invention have been described by way of example only and it should be appreciated that modifications and additions may be made thereto without departing from the scope thereof as defined in the appended claims.

The invention claimed is:

1. A fin assembly for aqua resistance exercise, comprising:

a strap comprising an inner strap and an outer strap, fastener(s) provided to an outside of the inner strap and an inside of the outer strap to releasably attach the inner and outer straps together, and one or more fins adapted to be received on the outer strap, a longitudinal position of the one or more fins secured by engagement of the inner strap to the outer strap, and wherein the length of the outer strap is longer than a length of the inner strap, so that an extending end portion of the outer strap can overlap and engage an opposite end of the outer strap to secure the fin assembly about the user's limb.

2. A fin assembly as claimed in claim 1, wherein the fasteners releasably attach the inner and outer straps together along substantially a full length of the inner strap.

3. A fin assembly as claimed in claim 1, wherein the fasteners are hook and loop type fasteners, and wherein the hooks or loops of the hook and loop fasteners is applied over substantially the full surface of the inner side of the outer strap, and the other of the hooks and loops is applied over substantially the full surface of the outer side of the inner strap.

4. A fin assembly as claimed in claim 1, wherein:

a fastener first-half is provided to the outside of the inner strap, and a corresponding opposite fastener second-half is provided to the inside of the outer strap to releasably attach to the fastener first half to releasably attach the inner and outer straps together, and a said fastener first half is provided to the outside of the outer strap, so that the inside of the extending end portion of the outer strap is releaseably attachable to the outside of an opposite end of the outer strap when the strap is wrapped around a user's limb.

5. A fin assembly as claimed in claim 4, wherein the fastener first half is hooks or loops of hook and loop fasteners and the fastener second half is corresponding loops or hooks of the hook and loops fasteners.

6. A fin assembly as claimed in claim 4, wherein the fastener first half covers substantially the full outside surface of outer strap, and/or the fastener first half covers substantially the full outside surface of inner strap, and/or the fastener second half substantially the full inside surface of outer strap.

7. A fin assembly as claimed claim 1, wherein each fin comprises a base and a longitudinal fin extending from the base, and wherein the base comprises a first aperture and a second aperture spaced apart in a longitudinal direction of the strap, so that the outer strap passes through the first aperture and the second aperture to receive the fin on the outer strap.

8. A fin assembly as claimed in claim 7, wherein the base comprises a first lateral side member, a central lateral member and a second lateral side member, the first aperture positioned between the first lateral side member and the central lateral side member, and the second aperture positioned between the central lateral member and the second lateral side member, and wherein a relative position of the central member to the first and second side members causes the outer strap to bend across the central member so that the inner surface of the outer strap is proud of an inner surface of each of the two side members to secure the outer strap to the inner strap by said fasteners between the first and second side members.

9. A fin assembly as claimed in claim 7, wherein the fin has a first lateral fin and a second lateral fin, wherein each of the first and second lateral fins are adjacent to an edge of the outer strap.

10. A fin assembly as claimed in claimed in claim 7, wherein the fin has an opening between the longitudinal fin and the base.

11. A fin assembly as claimed in claim 1, wherein the outer strap comprises indicators to indicate to a user a correct position to locate the one or more fins on the outer strap.

12. A fin assembly as claimed in claim 11, wherein each indicator comprises one or more cut-out portions of the outer strap, and the fin comprises a projection to be received in a corresponding cut-out portion.

13. A fin assembly as claimed in claim 1, wherein the fin comprises a projection to be received in a corresponding cut-out portion in the outer strap to position the fin correctly along the outer strap, and wherein the projection is located on the central lateral member of the base.

14. A fin assembly as claimed in claim 1, wherein the outer strap and the inner strap are completely separable.

15. A fin assembly as claimed in claim 1, wherein the outer strap and/or the inner strap is substantially non-extendable.

16. A fin assembly as claimed in claim 1, wherein outer strap is a strap or strap of hook material forming one side of the outer strap bonded to a strap or strap of loop material forming an opposite side of the outer strap.

17. A fin assembly as claimed in claim 1, wherein the outer strap is stamped from a sheet of material comprising a sheet of hook material forming one side of the sheet material bonded to a sheet of loop material forming an opposite side of the sheet material.

18. A fin assembly as claimed in claim 1, wherein the inner strap comprises a cushioning material and the fastener between the inner and outer straps is hook and loop material, and the hook or loop material of the inner strap is bonded to the cushion material of the inner strap to form the outside of the inner strap.

19. A kit of parts for a fin assembly for aqua resistance exercise, comprising:

a strap comprising an inner strap with fasteners provided to an outside surface of the inner strap, an outer strap with fasteners provided in an inside surface of the outer strap, the fasteners adapted to releasably attach the inner and outer straps together, and one or more fins adapted to be received on the outer strap, wherein a longitudinal position of the one or more fins fixed by engagement of the inner strap to the outer strap, and wherein the length of the outer strap is longer than a length of the inner strap, so that an extending end portion of the outer strap can overlap and engage an opposite end of the outer strap to secure the fin assembly about the user's limb.

20. A kit of parts as claimed in claim 19, wherein the kit of parts comprises a range of different fin sizes, each to provide a different resistance level in water.

* * * * *